US009096982B2

(12) United States Patent
Pellaers

(10) Patent No.: US 9,096,982 B2
(45) Date of Patent: Aug. 4, 2015

(54) ANIMAL EXCREMENT PICKER

(71) Applicant: Neil Pellaers, Winnipeg (CA)

(72) Inventor: Neil Pellaers, Winnipeg (CA)

( * ) Notice: Subject to any disclaimer, the term of this patent is extended or adjusted under 35 U.S.C. 154(b) by 0 days.

(21) Appl. No.: 14/518,306

(22) Filed: Oct. 20, 2014

(65) Prior Publication Data

US 2015/0137542 A1 May 21, 2015

Related U.S. Application Data

(60) Provisional application No. 61/897,333, filed on Oct. 30, 2013.

(51) Int. Cl.
*A01K 29/00* (2006.01)
*E01H 1/12* (2006.01)

(52) U.S. Cl.
CPC ..... *E01H 1/1206* (2013.01); *E01H 2001/1233* (2013.01); *E01H 2001/1293* (2013.01)

(58) Field of Classification Search
CPC ..... E01H 1/1206; E01H 2001/1233; E01H 2001/1293; A01K 23/005; A01D 9/06
USPC ..... 294/1.4, 50.5, 55.5, 61; 56/400.08; 172/21, 379
See application file for complete search history.

(56) References Cited

U.S. PATENT DOCUMENTS

| | | | | | |
|---|---|---|---|---|---|
| 1,043,168 | A | * | 11/1912 | Stiles | 294/50 |
| 1,246,487 | A | * | 11/1917 | Summers et al. | 294/61 |
| 1,523,633 | A | * | 1/1925 | Cousar et al. | 294/61 |
| 1,914,745 | A | * | 6/1933 | Kaufman | 172/379 |
| 1,993,314 | A | * | 3/1935 | Belford | 294/61 |
| 2,191,226 | A | * | 2/1940 | Clem | 30/129 |
| 2,291,160 | A | * | 7/1942 | Johnson | 172/247 |
| 4,422,681 | A | | 12/1983 | Laroche | |
| 4,791,995 | A | * | 12/1988 | Hochlan, Jr. | 172/21 |
| 6,634,163 | B2 | * | 10/2003 | Kill | 56/400.08 |

* cited by examiner

*Primary Examiner* — Dean Kramer
(74) *Attorney, Agent, or Firm* — Adrian D. Battison; Ade & Company Inc

(57) ABSTRACT

An animal excrement picker includes a handle and shank with a picker at the lower end defined by an array of support bars fixed in a plane at right angles to the shank. Each bar carries a plurality of spikes extending downwardly therefrom; in an array of generally parallel spikes in generally parallel rows and columns for engaging into and holding thereon an excrement element. A push member is operable to move longitudinally of the spikes for discarding the element from the spikes and is defined by a plurality of spaced parallel discard bars with each bar extending in a space between two parallel rows of the spikes so as to be movable along the spikes to push the element off the spikes.

10 Claims, 3 Drawing Sheets

ANIMAL EXCREMENT PICKER

This application claims the benefit under 35 USC 119(e) of Provisional application 61/897,333 filed Oct. 30, 2013.

The present invention pertains to pickers and, more particularly, to a device for gathering animal excrement.

BACKGROUND OF THE INVENTION

U.S. Pat. No. 4,422,681 (Laroche) issued Dec. 27, 1983 discloses an animal excrement picker which includes a handle with an elongated shank portion with a plate secured to the lower end thereof; a plurality of spikes are mounted to this plate and are enclosed in a housing that includes a top wall and a downwardly extending peripheral side wall; inside the housing, a perforated plate is provided with a series of openings, each in axial alignment with a respective spike; the top wall of the housing has a collar portion which frictionally engages the shank portion of the handle so that the spikes will remain in a lowermost position after having picked an excrement; a metallic plate may be added to the picker housing to close the open end thereof and is fixed thereto by means of magnets mounted to the side wall of the housing The above design does not allow a visual placement of the element to be picked so that both picking and discarding are done blindly. It is not therefore visible whether the element has been properly picked up or that it has been fully ejected without having to turn the unit upside-down to inspect it.

The picker disclosed herein is more cost effective to manufacture/produce than the above prior art. The prior art device would cost a lot more to produce and is more difficult to operate and clean thoroughly.

SUMMARY OF THE INVENTION

It is an object of the present invention to provide an animal picker which allows viewing of the element to be picked during the picking action.

According to the invention there is provided an animal excrement picker comprising:

a handle having an elongated shank portion;

a plurality of support bars arranged in an array lying in a plane at right angles to the shank portion and secured to one end of said shank so as to be held in fixed position relative thereto;

each bar carrying a plurality of spikes mounted to said bar and extending downwardly therefrom;

the spikes thus being arranged in an array of generally parallel spikes in generally parallel rows and columns with the spikes extending downwardly for engaging into and holding thereon an excrement element, when moved into a required position by the handle;

a push member operable to move longitudinally of the spikes by a manually operable component for discarding the element from the spikes;

the push member comprising a plurality of spaced parallel discard bars with each bar extending in a space between two parallel rows of the spikes so as to be movable along the spikes to push the element off the spikes.

The pusher bars on the present design and the spacing of the spikes on the support bars allows the operator to see directly through the unit to visually place it accurately/tactically on the element. The user can thus see both picking and discharge. In view of the spacing also, sanitary cleaning is also easier with the design because there is no plates for the excrement to collect between and the wider spacing of the simple bars which are as thin as possible and supported by minimum material allows cleaning fluid to enter these spaces for effective cleaning action.

Preferably there is no housing surrounding or above the spikes so that the element is visible on the spikes.

Preferably the discard bars are spaced with open areas therebetween to allow viewing of the element between the discard bars.

Preferably the discard bars are supported and connected together by only one or two connector bars at right angles to the discard bars to allow viewing of the element between the discard bars and the connector bar or bars.

Preferably the discard bars are supported and connected together by a single connector bar at right angles to the discard bars and arranged at an end of the rows of spikes.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
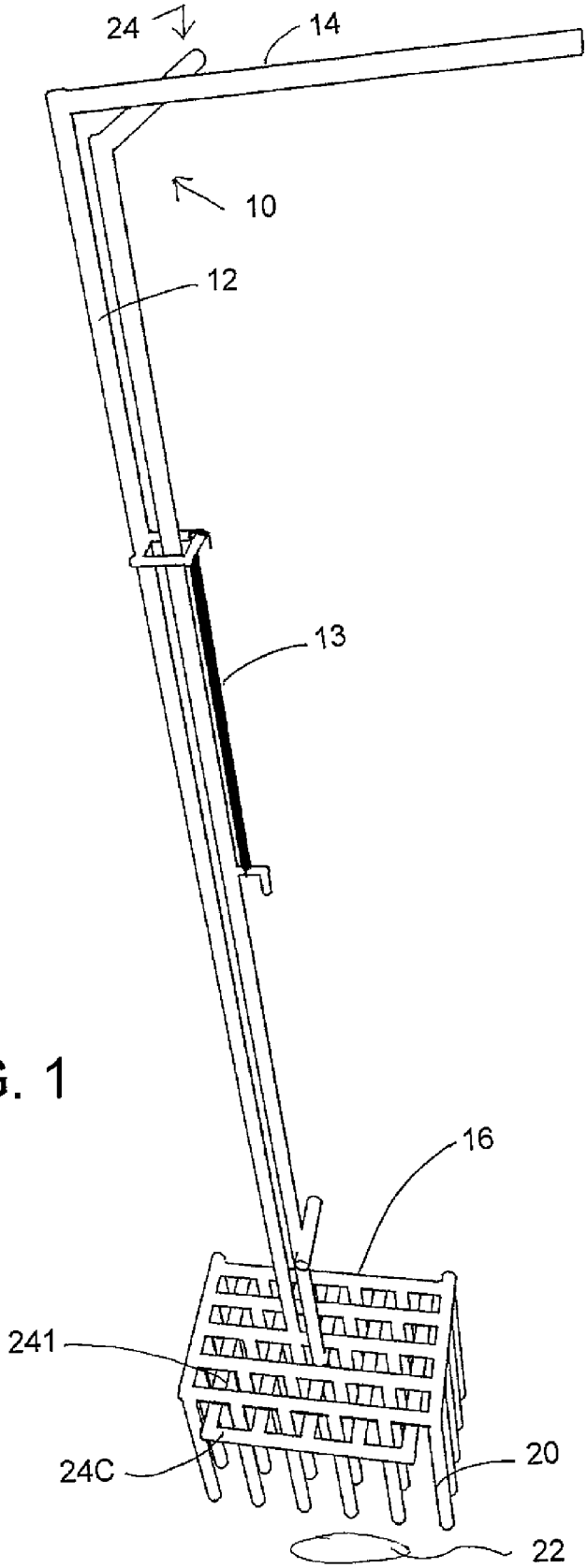
FIG. 1 is an isometric view of a picker according to the present invention.
Figure 2:
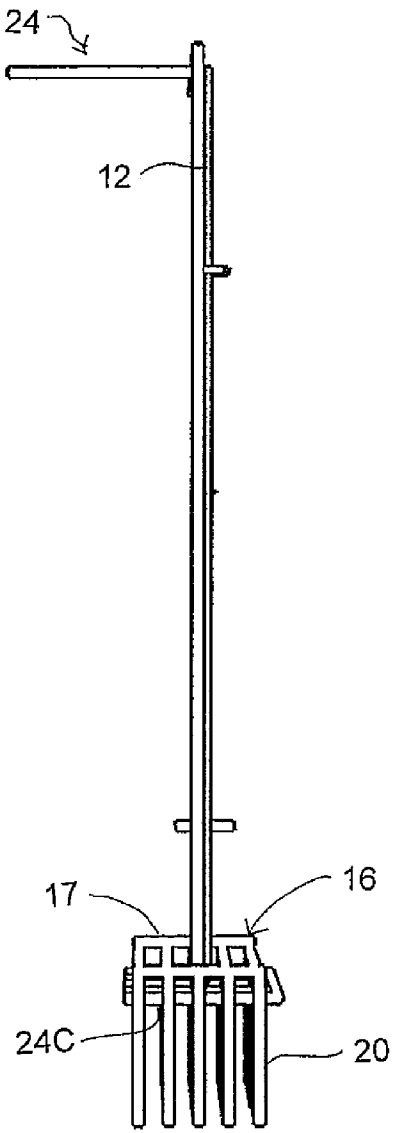
FIG. 2 is a side elevational view of the picker of FIG. 1
Figure 3:
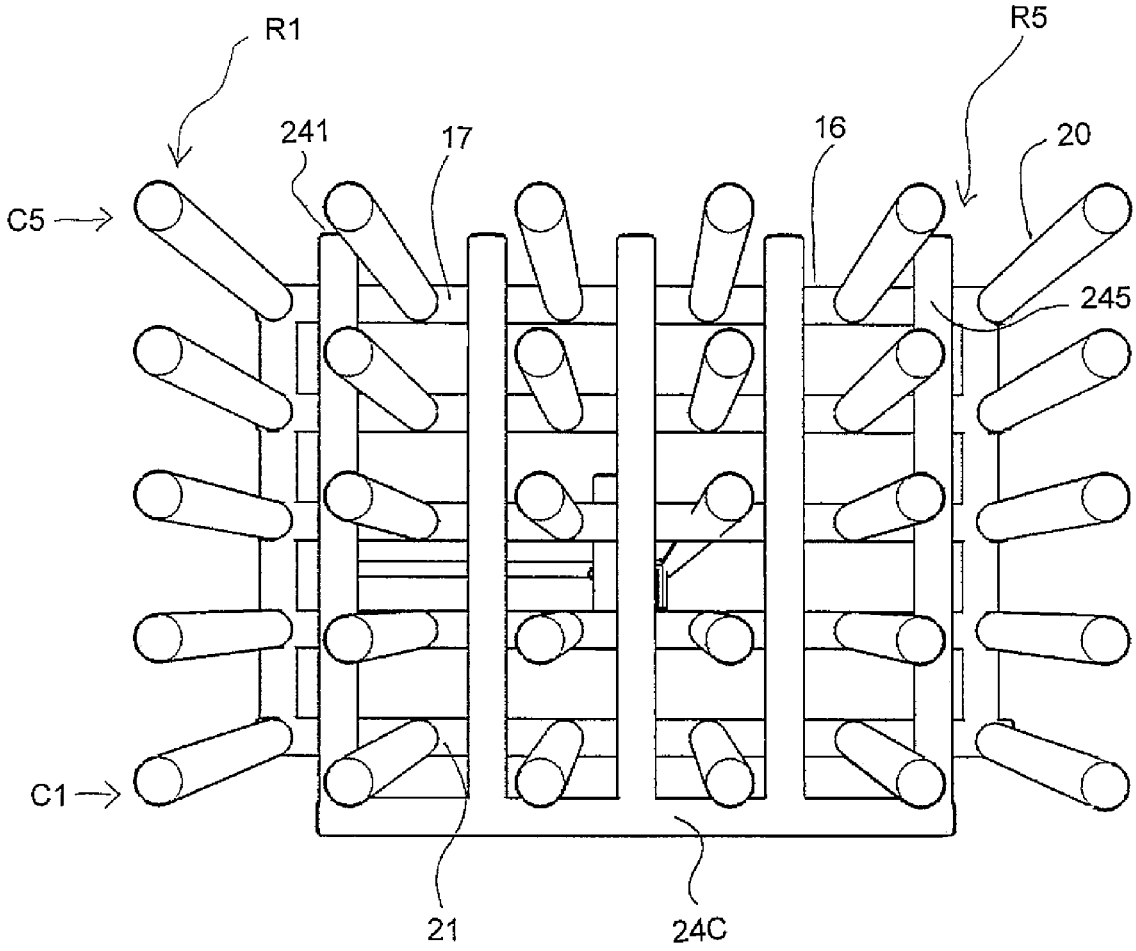
FIG. 3 is a perspective view from the bottom of the picker of FIG. 1.

Referring to the drawings, the animal excrement picker comprises a handle, generally denoted 10, which comprises an elongated shank portion 12 with a gripping portion 14 at one end thereof and a support 16 fixedly mounted to the other end thereof. To the lower side of support 16 are secured a plurality of spikes 20 which, in the embodiment illustrated, are in the form of nails; other elongated pin-like structures can be used. The provision of many spikes and having them very close together permits the pick-up of excrement, such as 22, that may have a large range of consistency.

The support of the spikes comprises a plurality of support bars 17 to 21 arranged in an array lying in a plane at right angles to the shank portion 12 and secured to one end of said shank 12 so as to be held in fixed position relative thereto.

Each support bar 17 to 21 carries a plurality of the spikes 20 mounted to the bar and extending downwardly therefrom with the spikes thus being arranged in an array of generally parallel spikes in generally parallel rows R1 to R5 and columns C1 to C5 with the spikes extending downwardly for engaging into and holding thereon an excrement element, when manually moved by the user into a required position by the handle.

The push member 24 is operable to move longitudinally of the spikes by a manually operable component for discarding the element from the spikes at the handle 10.

The push member comprises a plurality of spaced parallel discard bars 241 to 245 with each bar extending in a space between two parallel rows R1 to R5 of the spikes so as to be movable along the spikes to push the element 22 off the spikes.

There is no housing surrounding or above the spikes so that the element 22 is visible on the spikes and the discard bars 241 are spaced with open areas therebetween to allow viewing of the element between the discard bars. The discard bars 241 are supported and connected together by only a single connector bar 24C at right angles to the discard bars and arranged at an end of the rows of spikes.

To free the excrement, a required force will be exerted on the manually operable element of the handle 10 to overcome the resistance of a spring 13 and push the discard bars 241 to the bottom of the spikes to release the element 22.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An animal excrement picker comprising:

a handle having an elongated shank portion;

a plurality of support bars arranged in an array lying in a plane at right angles to the shank portion and secured to one end of said shank so as to be held in fixed position relative thereto;

each bar carrying a plurality of spikes mounted to said bar and extending downwardly therefrom;

the spikes thus being arranged in an array of generally parallel spikes in generally parallel rows and columns with the spikes extending downwardly for engaging into and holding thereon an excrement element, when moved into a required position by the handle;

a push member operable to move longitudinally of the spikes by a manually operable component for discarding the element from the spikes;

the push member comprising a plurality of spaced parallel discard bars with each bar extending in a space between two parallel rows of the spikes so as to be movable along the spikes to push the element off the spikes;

wherein the discard bars are supported and connected together by only one or two connector bars at right angles to the discard bars to allow viewing of the element between the discard bars and the connector bar or bars.

2. The animal excrement picker according to claim 1 wherein there is no housing surrounding or above the spikes so that the element is visible on the spikes.

3. The animal excrement picker according to claim 1 wherein the discard bars are spaced with open areas therebetween to allow viewing of the element between the discard bars.

4. An animal excrement picker comprising:

a handle having an elongated shank portion;

a plurality of support bars arranged in an array lying in a plane at right angles to the shank portion and secured to one end of said shank so as to be held in fixed position relative thereto;

each bar carrying a plurality of spikes mounted to said bar and extending downwardly therefrom;

the spikes thus being arranged in an array of generally parallel spikes in generally parallel rows and columns with the spikes extending downwardly for engaging into and holding thereon an excrement element, when moved into a required position by the handle;

a push member operable to move longitudinally of the spikes by a manually operable component for discarding the element from the spikes;

the push member comprising a plurality of spaced parallel discard bars with each bar extending in a space between two parallel rows of the spikes so as to be movable along the spikes to push the element off the spikes;

wherein the discard bars are supported and connected together by a single connector bar at right angles to the discard bars and arranged at an end of the rows of spikes.

5. The animal excrement picker according to claim 4 wherein there is no housing surrounding or above the spikes so that the element is visible on the spikes.

6. The animal excrement picker according to claim 4 wherein the discard bars are spaced with open areas therebetween to allow viewing of the element between the discard bars.

7. An animal excrement picker comprising:

a handle having an elongated shank portion;

a plurality of support bars arranged in an array lying in a plane at right angles to the shank portion and secured to one end of said shank so as to be held in fixed position relative thereto;

each bar carrying a plurality of spikes mounted to said bar and extending downwardly therefrom;

the spikes thus being arranged in an array of generally parallel spikes in generally parallel rows and columns with the spikes extending downwardly for engaging into and holding thereon an excrement element, when moved into a required position by the handle;

a push member operable to move longitudinally of the spikes by a manually operable component for discarding the element from the spikes;

the push member comprising a plurality of spaced parallel discard bars with each bar extending in a space between two parallel rows of the spikes so as to be movable along the spikes to push the element off the spikes;

wherein the support bars are supported and connected together by only one or two connector bars at right angles to the support bars to allow viewing of the element between the support bars and the connector bar or bars.

8. The animal excrement picker according to claim 7 wherein the discard bars are supported and connected together by only one or two connector bars at right angles to the discard bars to allow viewing of the element between the discard bars and the connector bar or bars.

9. The animal excrement picker according to claim 7 wherein there is no housing surrounding or above the spikes so that the element is visible on the spikes.

10. The animal excrement picker according to claim 7 wherein the discard bars are spaced with open areas therebetween to allow viewing of the element between the discard bars.

* * * * *